US012144409B1

(12) United States Patent
Boadi

(10) Patent No.: US 12,144,409 B1
(45) Date of Patent: Nov. 19, 2024

(54) CONFIGURABLE FLAT IRON

(71) Applicant: Kelyn Boadi, Normal, IL (US)

(72) Inventor: Kelyn Boadi, Normal, IL (US)

( * ) Notice: Subject to any disclaimer, the term of this patent is extended or adjusted under 35 U.S.C. 154(b) by 0 days.

(21) Appl. No.: 18/478,584

(22) Filed: Sep. 29, 2023

(51) Int. Cl.
*A45D 1/28* (2006.01)
*A45D 2/00* (2006.01)

(52) U.S. Cl.
CPC ..... *A45D 2/001* (2013.01); *A45D 1/28* (2013.01); *A45D 2/00* (2013.01)

(58) Field of Classification Search
CPC ..... A45D 2/001; A45D 1/10
See application file for complete search history.

(56) References Cited

U.S. PATENT DOCUMENTS 4,211,914 A * 7/1980 Jackson ..... A45D 1/04 219/533
6,627,852 B1 * 9/2003 Savone ..... A45D 1/10 219/524
7,243,661 B2 7/2007 Lun et al.
8,232,505 B2 * 7/2012 Hottenrott ..... A45D 1/06 219/244
9,521,891 B2 12/2016 Ragosta et al.
10,506,859 B2 * 12/2019 Putzer ..... A45D 2/002
2005/0150511 A1 7/2005 Park
2009/0301509 A1 12/2009 Leung
2011/0220141 A1 * 9/2011 Chan ..... A45D 1/04 132/229
2021/0059375 A1 3/2021 Ashkenazi et al.

FOREIGN PATENT DOCUMENTS

KR 10-2011-0007333 * 1/2011
KR 101263801 B1 5/2013

OTHER PUBLICATIONS

ESPACENET Machine translation of Yoo; available Jan. 2011.*

* cited by examiner

*Primary Examiner* — Rachel R Steitz
*Assistant Examiner* — Brianne E Kalach
(74) *Attorney, Agent, or Firm* — Foley & Lardner LLP

(57) ABSTRACT

Provided herein is a hair-styling device including a first arm having a first proximal end and a first distal end with a first longitudinal axis defined therebetween; a first heating plate disposed on a first surface of the first arm; a second arm having a second proximal end and a second distal end; a joint portion including a hinge joining the first arm adjacent the first distal end and the second arm adjacent the second distal end, wherein the first arm is rotatable around the first longitudinal axis at least about 90 degrees so as to provide the first heating plate in a desired rotational position.

15 Claims, 12 Drawing Sheets

CONFIGURABLE FLAT IRON

BACKGROUND

The present invention relates generally to the field of tools for styling hair.

Various hair styling tools have been created over time to accomplish tasks such as straightening, curling, smoothing, and flattening hair. However, many hair styling devices are designed for a single task and lack the flexibility for additional use scenarios, forcing users to purchase multiple devices for each task they may wish to perform. There is a need for hair styling tools that are able to be safely configured to perform multiple tasks.

SUMMARY OF THE INVENTION

One embodiment of the invention relates to a hair-styling device. In one embodiment, the hair-styling device includes a first arm having a first proximal end and a first distal end opposite the first proximal end; a first heating plate disposed on a first surface of the first arm; a second arm having a second proximal end and a second distal end; and a joint portion comprising a hinge joining the first arm adjacent the first distal end and the second arm adjacent the second distal end, wherein the first arm is rotatable around a first longitudinal axis at least about 90 degrees.

In some embodiments, the first arm is rotatable around the first longitudinal axis about 180 degrees. The hair-styling device may further comprise a second heating plate that is disposed on an inner surface of the second arm. In some embodiments, the hair-styling device includes a locking mechanism configured to selectably secure the first arm in a first rotated position and in a second rotated position.

In some embodiments, the first heating plate can be electrically coupled to an electricity source such that the electricity source is configured to provide an electrical current to the first heating plate. The electricity source may comprise a cord for receiving electricity from an electrical outlet or other power source, a battery, or a combination thereof. In some embodiments including a battery, the battery is rechargeable.

In some embodiments, the hair-styling device may also comprise a user control enabling the user to adjust the amount of electrical current to be provided to the first heating plate by the electricity source. The user control may comprise one or more of a dial and a variable resistor and may further comprise a visual indicator configured to provide visual feedback to a user. This visual indicator may comprise one or more of a light, a light-emitting diode (LED), a display, and a screen.

An aspect provided herein is a method for making the hair-styling device by providing a first arm having a first proximal end and a first distal end opposite the first proximal end, the first arm having a first heating plate disposed on a first surface of the first arm, and providing a second arm having a second proximal end and a second distal end. The two arms are connected via a hinge portion that joins the first arm adjacent the first distal end to the second arm adjacent the second distal end. The first arm in this configuration is rotatable around a first longitudinal axis at least about 90 degrees and may, in some embodiments, rotate about 180 degrees. The first arm in a first rotated position and in a second rotated position is secured into place via a locking mechanism. This embodiment further comprises an electricity source, wherein the first heating plate is electronically coupled to the electricity source such that the electricity source is configured to provide an electrical current to the first heating plate. A controller may be coupled to the first heating plate and the electricity source such that the amount of the electrical current provided to the first heating plate is adjustable by a user. This controller comprises at least one of a dial, a button, a switch, a toggle, a touch screen, and a variable resistor.

In some embodiments, the hair-styling device includes a visual indicator configured to provide visual feedback to a user. This visual indicator may include one or more of a light, a light-emitting diode (LED), a display, and a screen.

In a third aspect provided herein, a hair-styling device comprises a first arm having a first proximal end and a first distal end opposite the first proximal end, a second arm having a second proximal end and a second distal end, and a joint portion comprising a hinge joining the first arm adjacent the first distal end and the second arm adjacent the second distal end. A first heating plate is disposed on a first surface of the first arm, and a second heating plate is disposed on a first surface of the second arm. A third heating plate is disposed on a second surface of the first arm. The first heating plate may, for instance, be disposed on an inner surface of the first arm and the third heating plate disposed on an outer surface of the first arm. An electricity source is electrically coupled with the first heating plate, the second heating plate, and the third heating plate. The embodiment also contains a user control that is configured to control the amount of electrical current provided to the first heating plate, the second heating plate, and the third heating plate by the electricity source. The embodiment may further include a visual indicator configured to provide visual feedback to a user.

DETAILED DESCRIPTION

Figure 1:
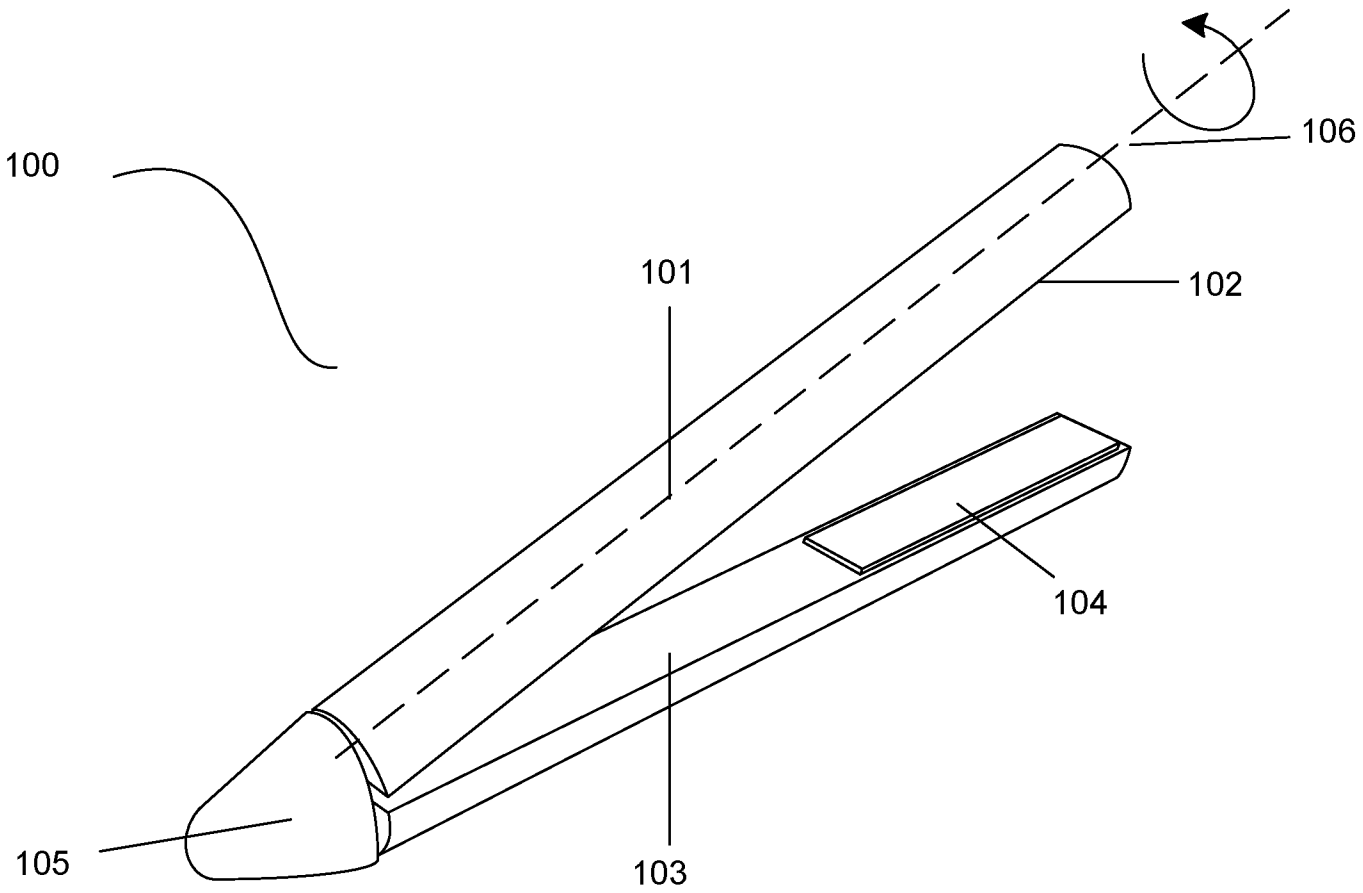
FIG. 1 is an isometric view of the hair-styling device assembly according to an embodiment in a first configuration with the first heating plate facing inwards.
Figure 2:
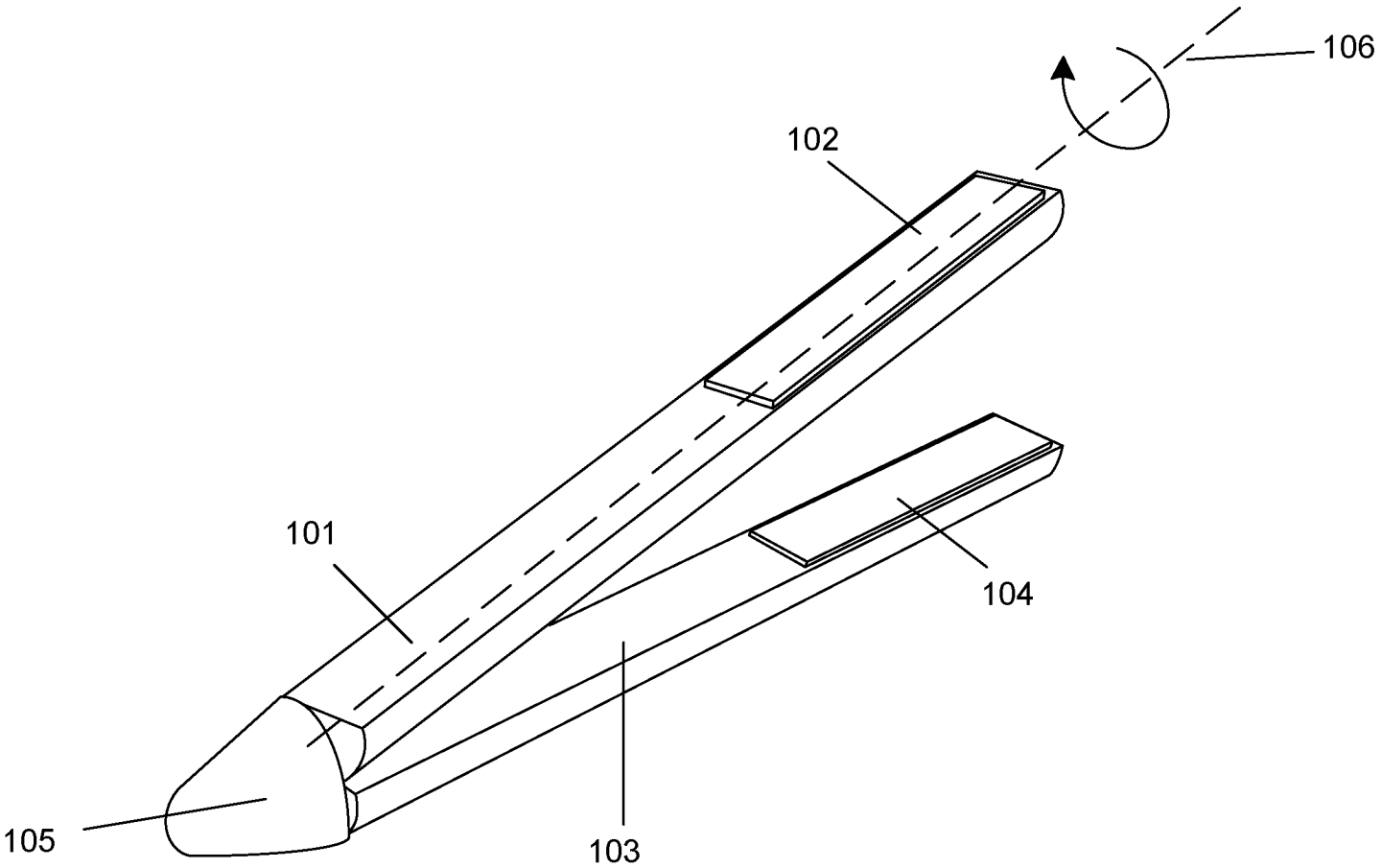
FIG. 2 is an isometric view of the hair-styling device assembly according to an embodiment in a second configuration with the first heating plate facing outwards.
Figure 3:
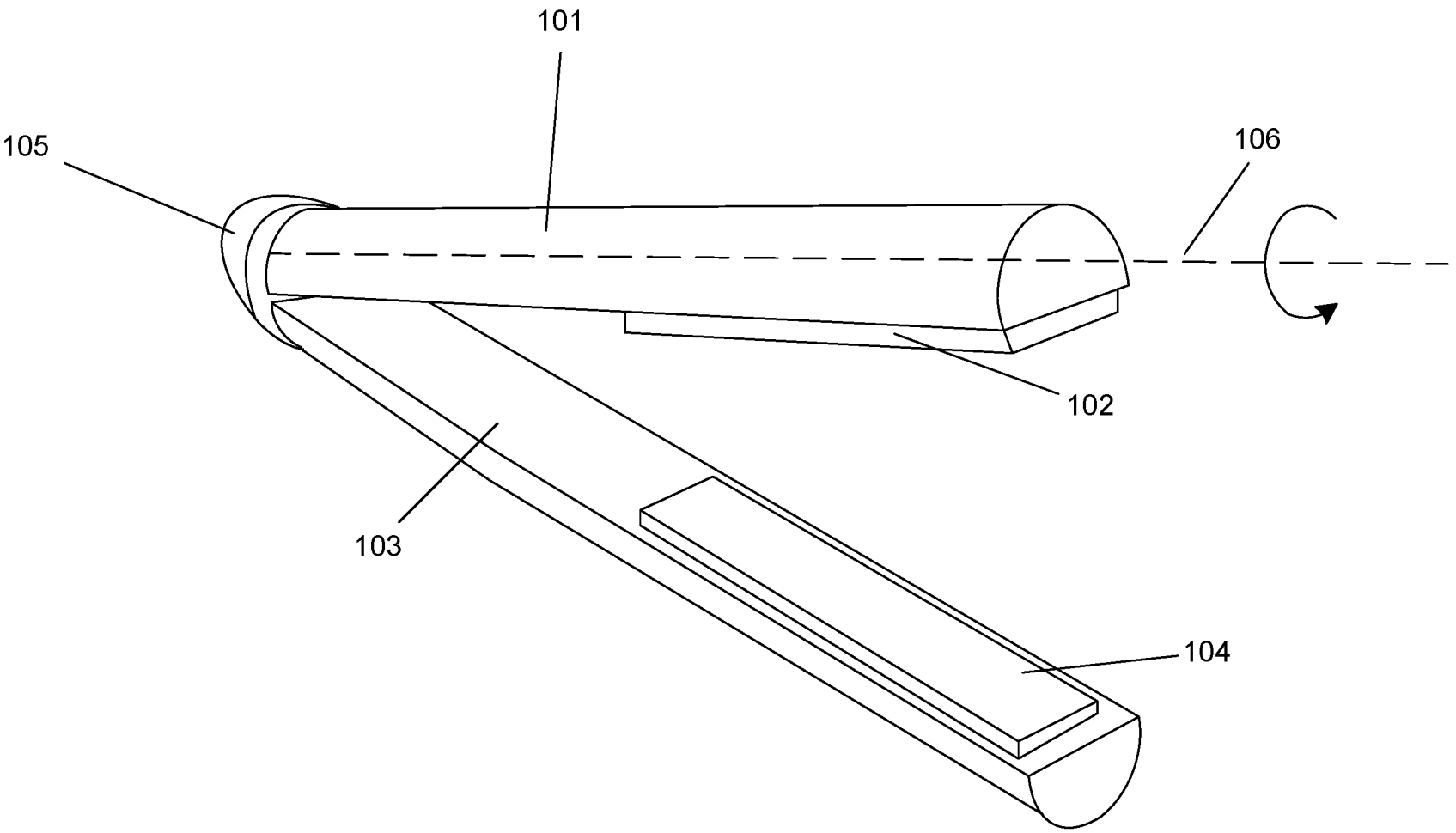
FIG. 3 is a top, side isometric view of the hair-styling device assembly according to an embodiment in a first configuration with the first heating plate facing inwards.
Figure 4:
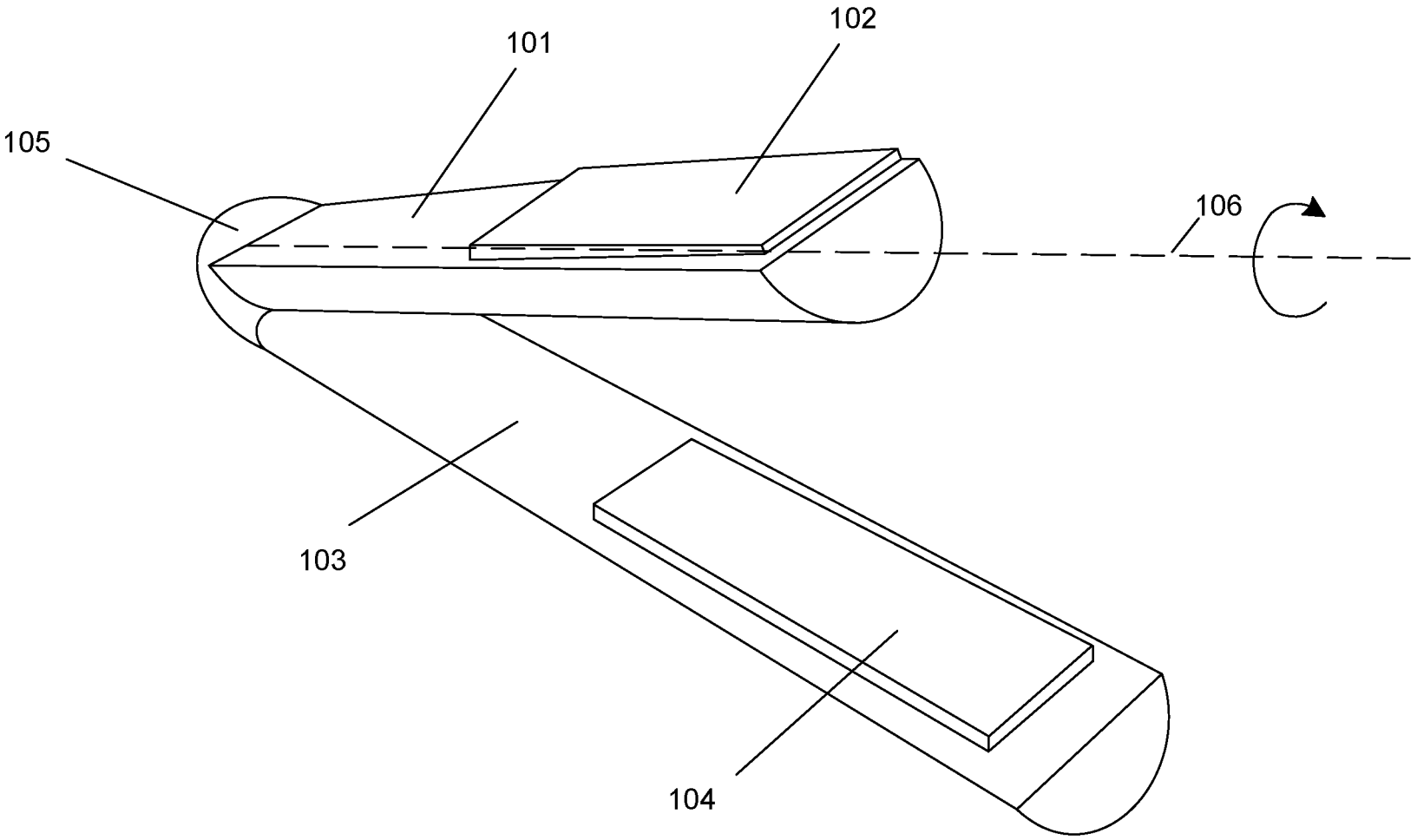
FIG. 4 is a top, side isometric view of the hair-styling device assembly according to an embodiment in a second configuration with the first heating plate facing outwards.
Figure 5:
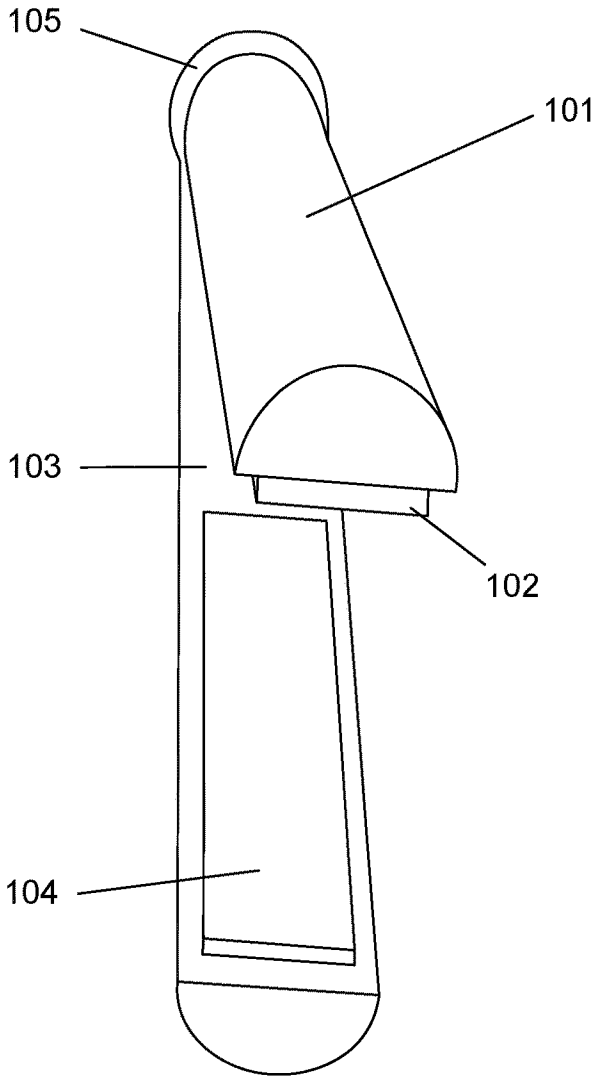
FIG. 5 is a top, front isometric view of the hair-styling device assembly according to an embodiment in a first configuration with the first heating plate facing inwards.
Figure 6:
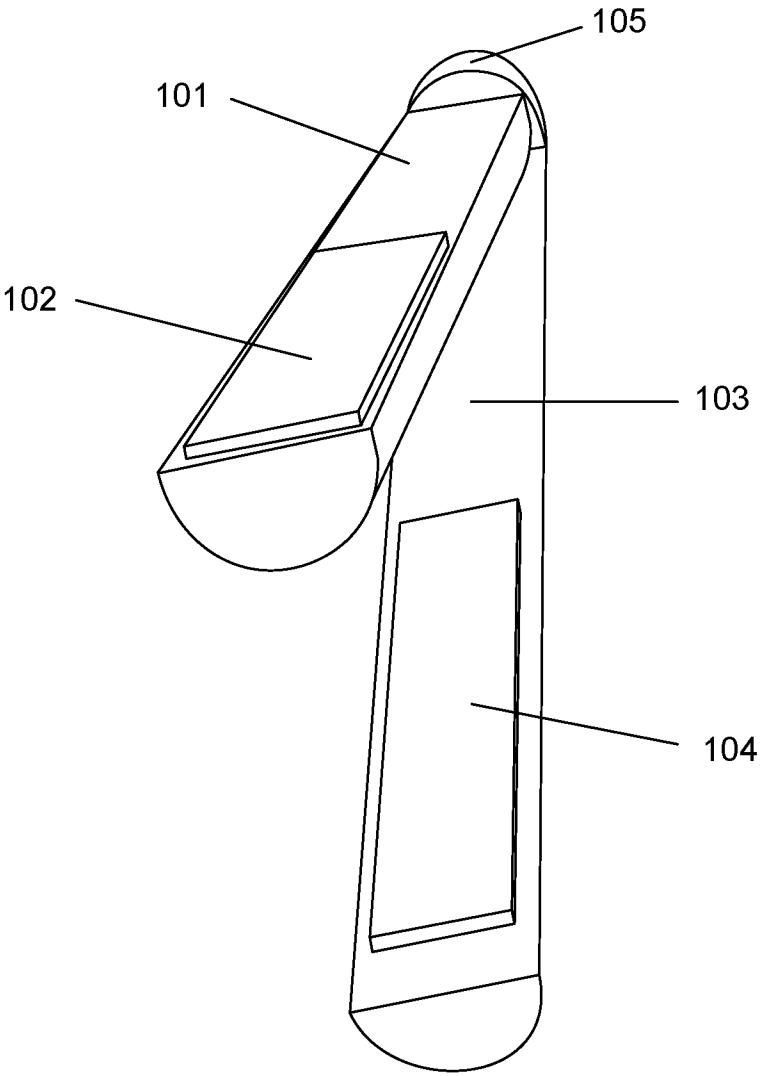
FIG. 6 is a top, front isometric view of the hair-styling device assembly according to an embodiment in a second configuration with the first heating plate facing outwards.
Figure 7:
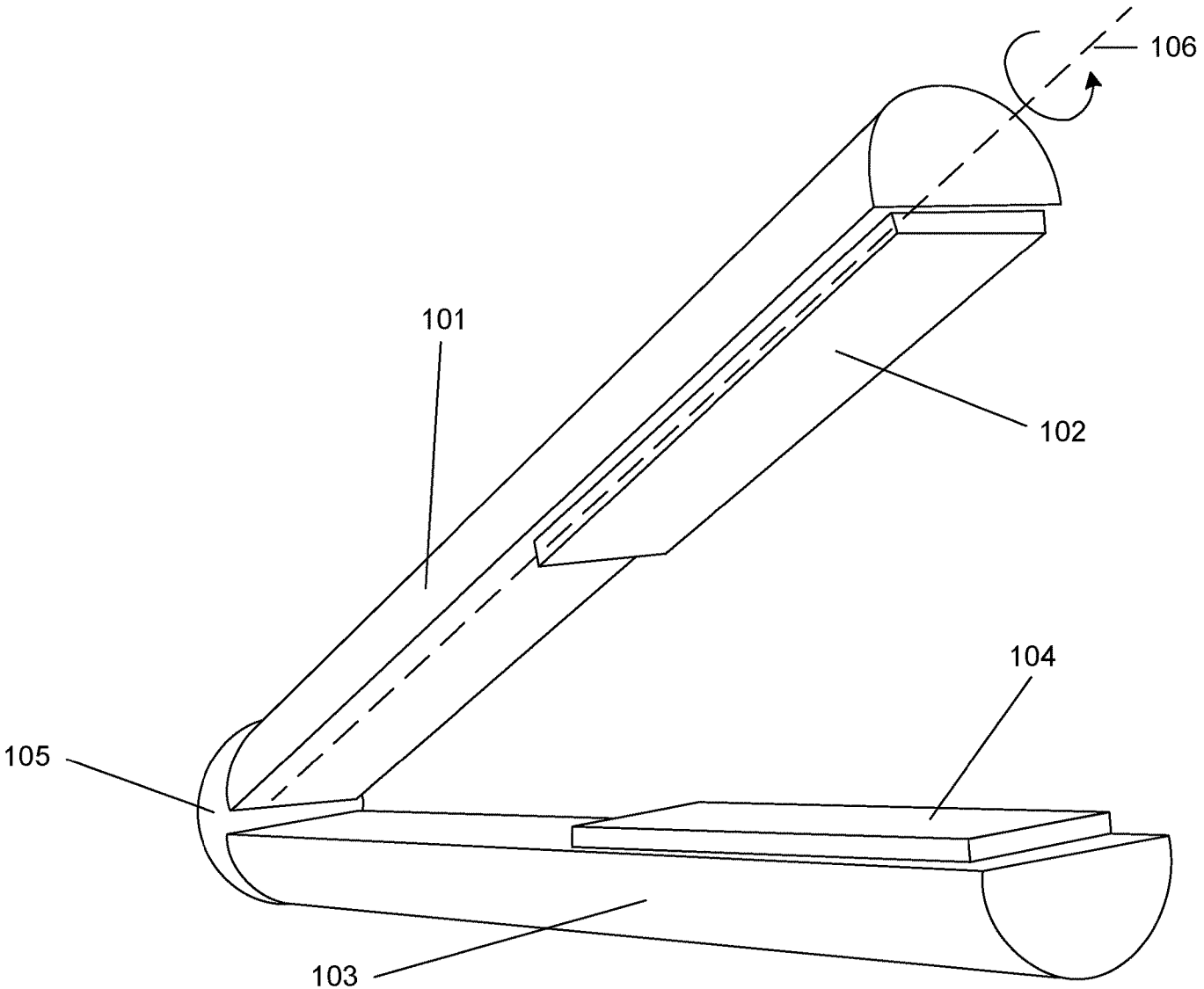
FIG. 7 is a side isometric view of the hair-styling device assembly according to an embodiment in a first configuration with the first heating plate facing inwards.
Figure 8:
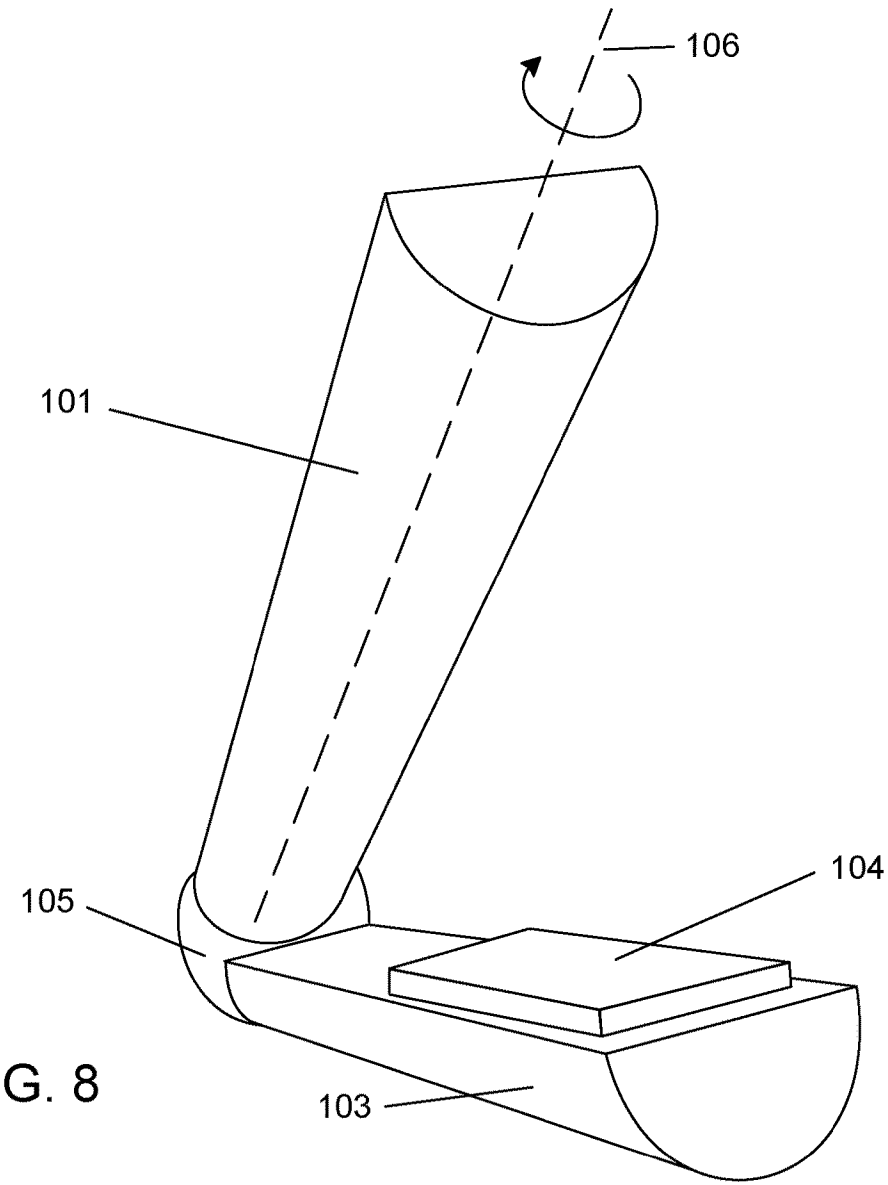
FIG. 8 is a side isometric view of the hair-styling device assembly according to an embodiment in a second configuration with the first heating plate facing outwards.

Disclosed herein is a configurable hair-styling device. In one embodiment, the hair-styling device is configurable to provide heating plates in several positions. Referring to FIG. 1-8, according to an embodiment, the hair-styling device 100 includes a first arm 101 having a first proximal end and a first distal end with a first longitudinal axis 106 defined therebetween. A first heating plate, suitable for applying heat to hair, 102 is disposed on a first surface of the first arm 101. A second arm 103 has a second proximal end and a second distal end. The second arm optionally includes a second heating plate disposed on a surface of the second arm.

A joint portion 105 joins the first arm 101 adjacent the first distal end and the second arm 103 adjacent the second distal end. In one embodiment, the joint portion forms a hinge, such that the first and second arms may be positioned in an open position and a closed position.

The heating plates function to convert electrical energy into heat energy such that a user may apply the heated plates to hair. Each of the first heating plate and the second heating plate may comprise one or more individual heating elements. The first and second heating plates are preferably positioned on an inner surface of the respective arms, such that the heating plates may be applied to hair by positioning the arms around the hair and then closing the arms of the device. Once applied, the device can be manipulated to straighten and curl portions of the hair as desired by the user. The heating plates may be made of metal, ceramic, ceramic-coated metal, tourmaline, or other materials known in the art. The heating plates may present a flat surface, or they may be curved to follow the shape of the surface of the arm. The heating plates may have grooves, oscillations, or other shaped features.

According to an embodiment, the first arm 101 is rotatable around the first longitudinal axis 106 of the first arm from a first rotational position to a second rotational position. In some embodiments, the first arm is configured to rotate at least about 90 degrees. In other embodiments, the first arm is configured to rotate at least about 180 degrees. While in the first rotational position, the heating plate disposed on the first arm is positioned on an inner surface of the first arm such that the heating plate is not exposed while the device is in the closed position. The rotation of the first arm permits a user to expose the heating plate of the first arm while the device is in the closed position by rotating the inner surface sufficiently that it translates to an outer surface.

Though only the first arm 101 is shown to be able to rotate in relation to the second arm 103 in FIG. 1-8, both arms may be configured to be able to rotate in relation to each other.

Further, though the embodiments in FIG. 1-8 show the arms with a rectangular shape and semicircular cross-section, the invention is not limited to the depicted form. The cross-section of the arms 101, 103 may take a variety of shapes, including a semi-circle, a circle, oval, stadium, square, or a rectangle. The first and second arms and the joint portion may each be made of any appropriate material, including multiple layers of the same or different material, including durable plastics, natural or synthetic polymers, ceramics, metals, and/or combinations thereof. Additionally, the joint 105 need not be a hinge joint and may comprise any joint type that accomplishes the task of connecting the first and second arm together and allowing the two arms to move relative to one another, including a ball-and-socket, pivot, saddle, or plane joint.

Figure 9:
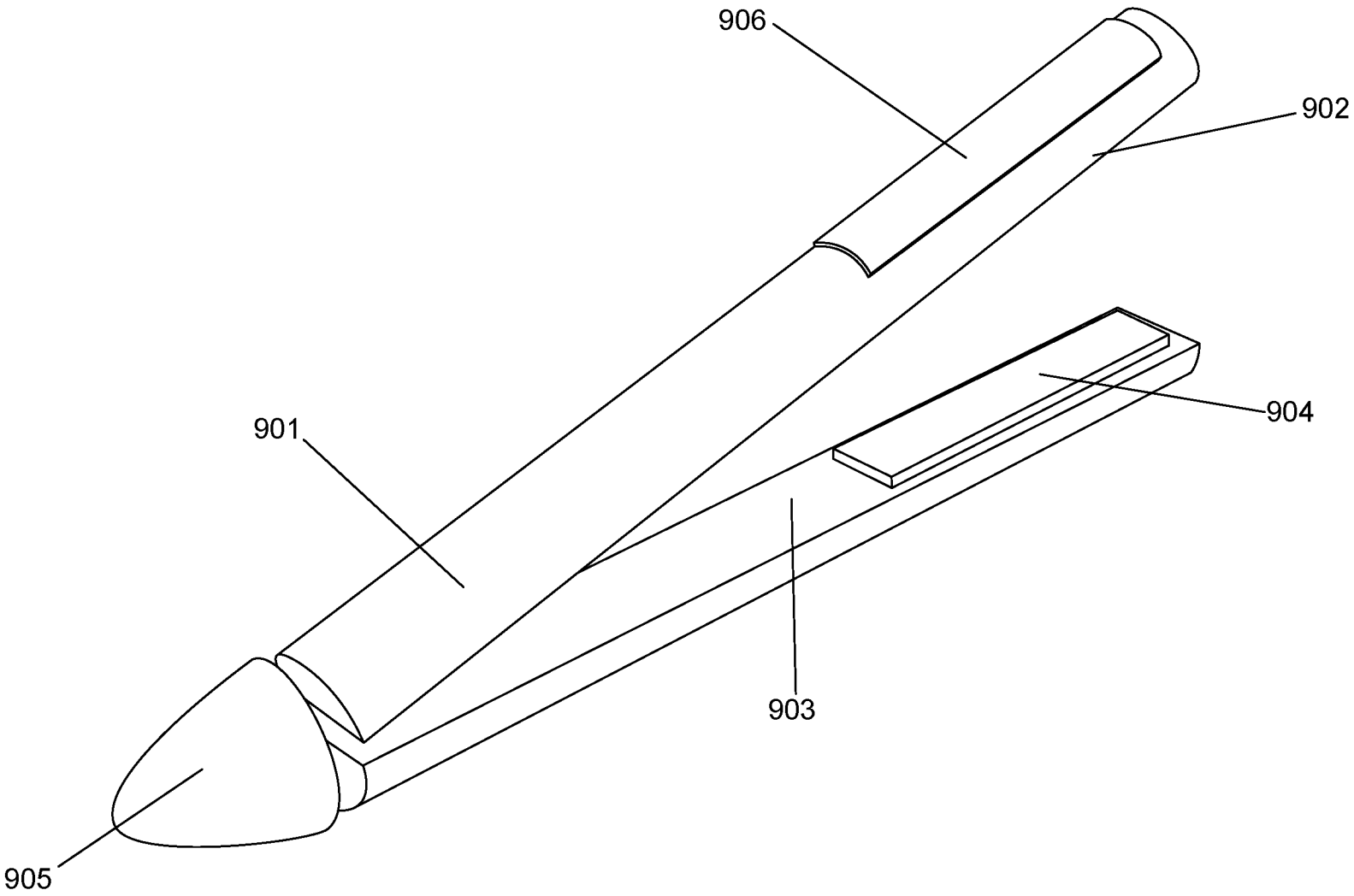
FIG. 9 is an isometric view of the hair-styling device assembly according to an embodiment with three heating plates.
Figure 10:
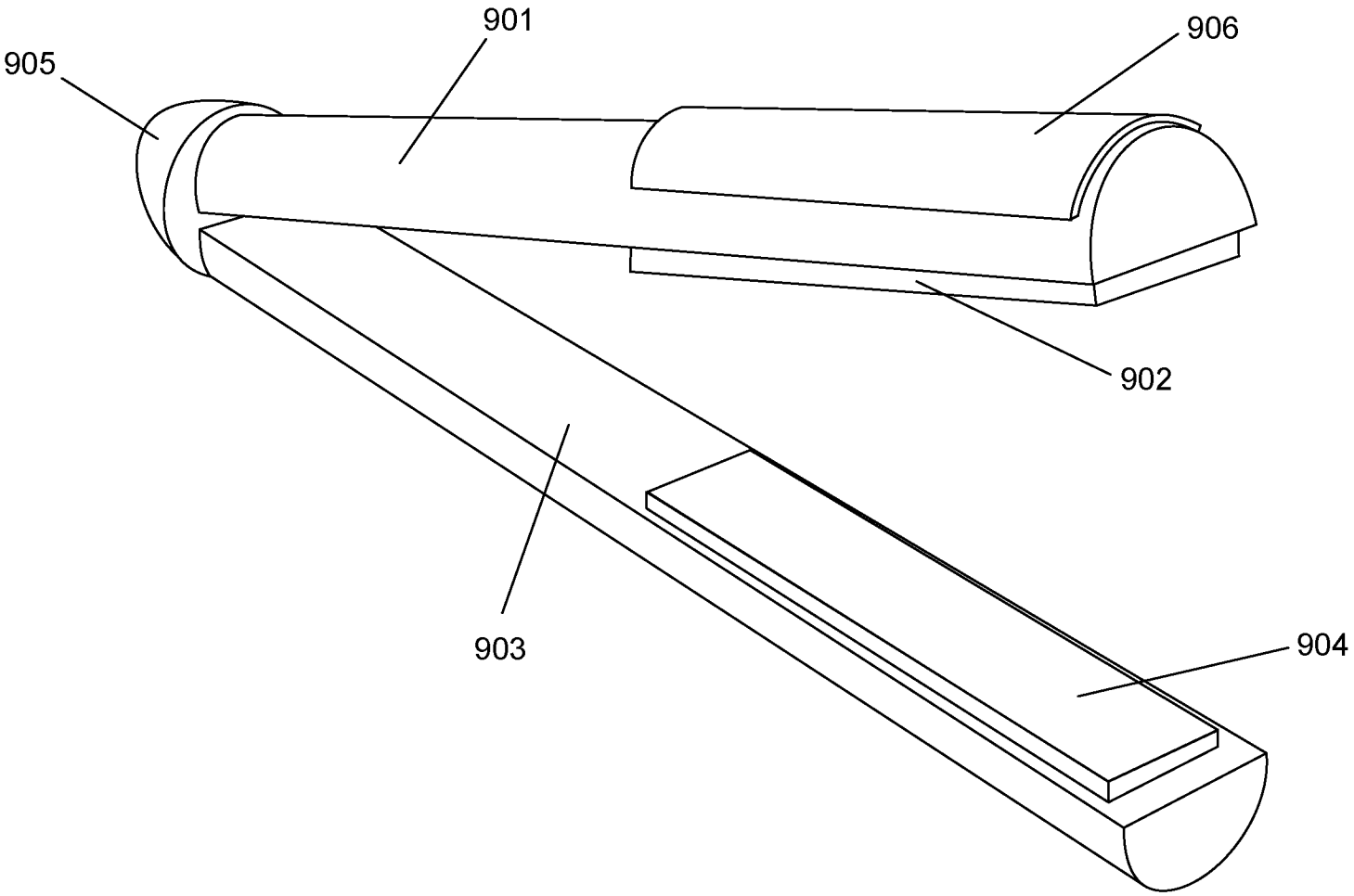
FIG. 10 is a top, side isometric view of the hair-styling device assembly according to an embodiment with three heating plates.

Referring to FIG. 9-10, in some embodiments the hair-styling device includes a third heating plate 906 disposed on a second surface of the first arm 901. In some embodiments, the first heating plate 902 is disposed on an inner surface of the first arm 901 and the third heating plate 906 is disposed on an outer surface of the first arm 901. The first heating plate 902, as well as the second 904 and third heating plates 906, may be electrically coupled to an electricity source configured to provide an electrical current to the heating plates. In some embodiments, a user control is provided so that electrical current can be selectably provided to the first and second heating plates or to the third heating plate. The electricity source may comprise a cord for receiving electricity from an electrical outlet or other power source, a battery, or any other method for delivering power to the device that would be known by a person of skill in the art.

Figure 11:
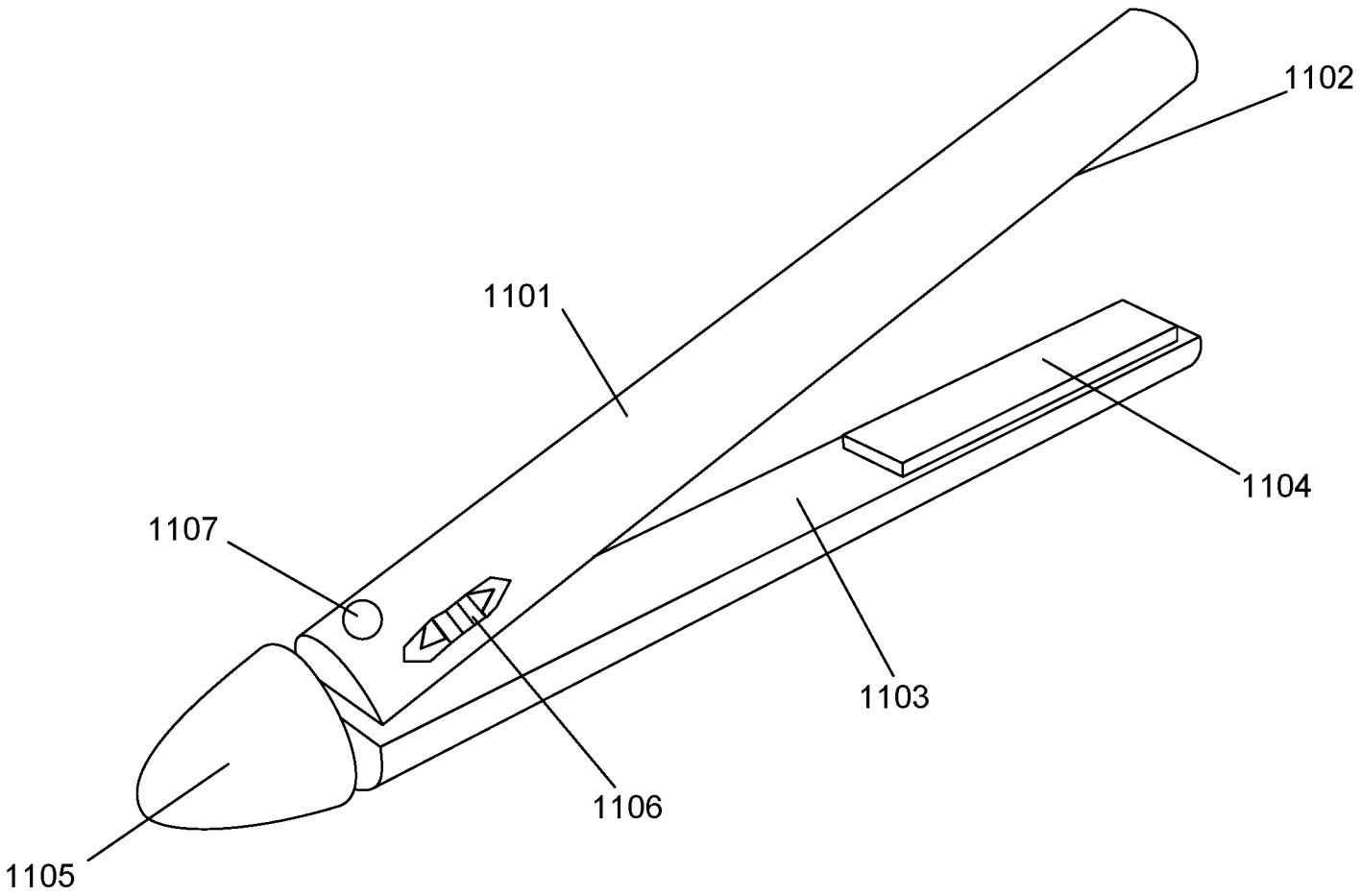
FIG. 11 is an isometric view of the hair-styling device assembly featuring user controls according to an embodiment.

Referring to FIG. 11, one embodiment of the user control system is shown, comprising a light indicator 1107 and a dial 1106 and a variable resistor that enable the user to control the amount of electrical current provided to the heating plates. The dial 1106 can be located anywhere along the side of the hair-styling device. For example, in some embodiments, the user control is positioned on an arm of the device. In some embodiments, the user control is positioned on an outer surface of one of the arms. In some embodiments, the user control is located on an internal surface of one of the arms. In other embodiments, the user control is positioned on the hinge portion.

In some embodiment, the user control system includes one or more buttons. In some embodiments, the user control system includes two buttons. In some embodiments, a first button allows the user to increase the amount of current reaching the plates, and a second button allows the user to decrease the amount of current reaching the plates. In some embodiments, a light indicator 1107 is positioned on the hair-styling device in a location that would be visible to the user during operation of the device. The light indicator is used to indicate to the user information, such as the fact that the hair-styling device is receiving electricity, or that at least one of the heating plates on the device has reached a predetermined temperature.

Figure 12:
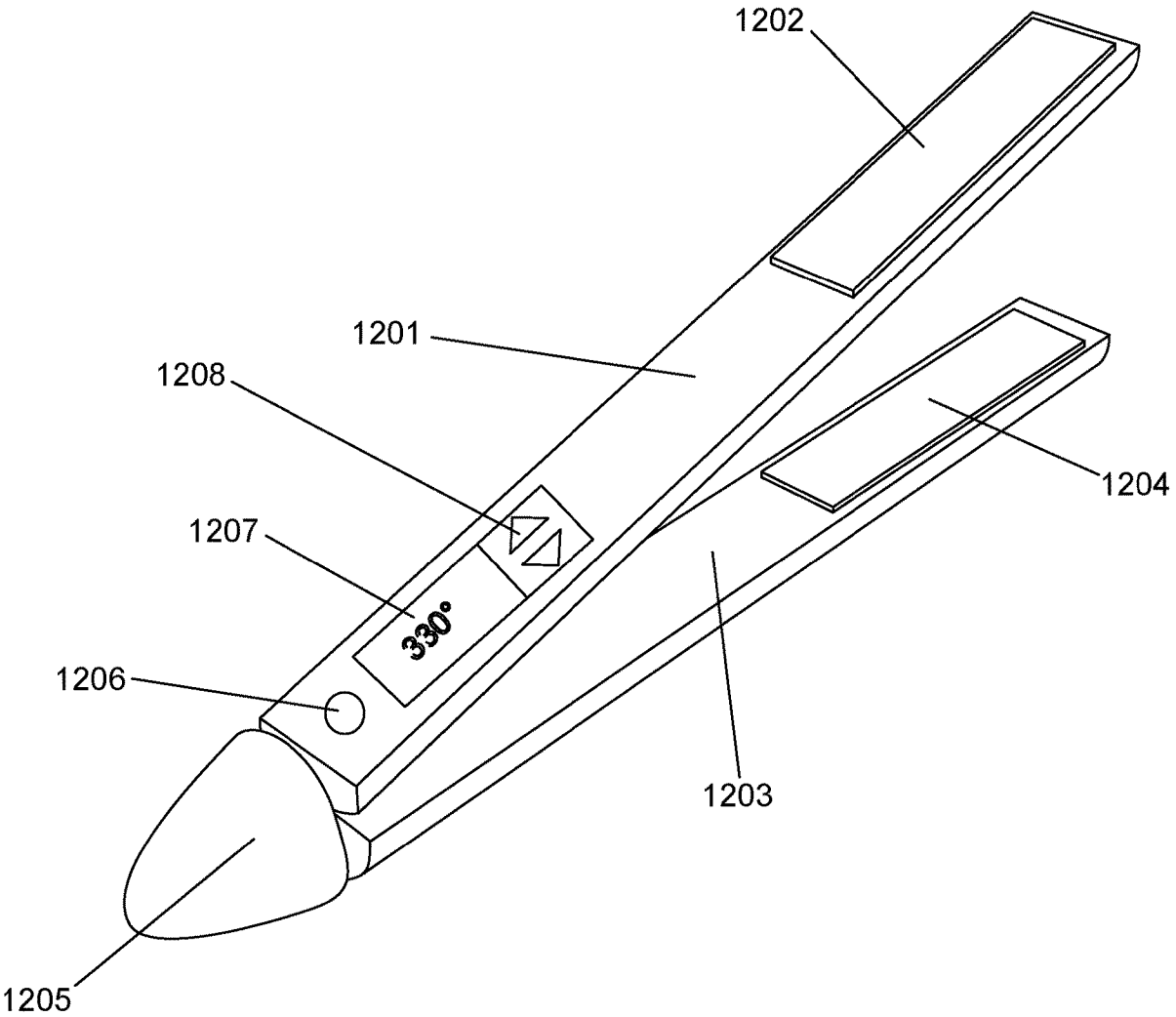
FIG. 12 is an isometric view of the hair-styling device assembly featuring user controls according to an embodiment.

Referring to FIG. 12, another embodiment of the user control system is shown, comprising a light indicator 1206, a visual indicator 1207, a dial 1208 and a variable resistor that enable the user to control the amount of electrical current provided to the heating plates. The dial 1208 can be located anywhere on the hair-styling device. For example, in some embodiments, the user control is positioned on an arm of the device. In some embodiments, the user control is positioned on an outer surface of one of the arms. In some embodiments, the user control is located on an internal surface of one of the arms. In other embodiments, the user control is positioned on the hinge portion.

In some embodiment, the user control system includes one or more buttons. In some embodiments, the user control system includes two buttons. In some embodiments, a first button allows the user to increase the amount of current reaching the plates, and a second button allows the user to decrease the amount of current reaching the plates. In some embodiments, a light indicator 1206 is positioned on the hair-styling device in a location that would be visible to the user during operation of the device. The light indicator is used to indicate to the user information, such as the fact that the hair-styling device is receiving electricity, or that at least one of the heating plates on the device has reached a predetermined temperature. The embodiments represented in FIG. 11-12 are just two example embodiments of the user control system. The user control system can take any other form that would be known to a person of skill in the art.

In some embodiments, the hair-styling device may include a speaker for producing sounds. Such sounds may alert a user when the device has reached a predetermined temperature and is ready for use. The sounds may also alert a user when the device has cooled to a predetermined temperature.

What is claimed is:

1. A hair-styling device, comprising:

a first arm extending along a longitudinal axis between a first proximal end and a first distal end;

a first heating plate disposed on a first surface of the first arm;

a second arm having a second proximal end and a second distal end;

a hinge connecting the first arm adjacent the first distal end with the second arm adjacent the second distal end such that the first and second arm pivot about a pivot axis between an open position and a closed position;

wherein the first arm is rotatable in relation to the second arm and rotates about the longitudinal axis such that the heating plate on the first surface of the first arm faces the second arm in a first position, and faces away from the second arm in a second position;

wherein, in the closed position, the heating plate on the first surface of the first arm can be selectably oriented in either of the first position or the second position.

2. The hair-styling device according to claim 1, wherein the first arm is rotatable around the longitudinal axis about 180 degrees.

3. The hair-styling device according to claim 1, further comprising a second heating plate disposed on an inner surface of the second arm.

4. The hair-styling device according to claim 1, wherein the first heating plate is electrically coupled to an electricity source such that the electricity source is configured to provide an electrical current to the first heating plate.

5. The hair-styling device according to claim 4, further comprising a user control adjustable to control an amount of the electrical current to be provided to the first heating plate by the electricity source.

6. The hair-styling device according to claim 5, wherein the user control comprises one or more of a dial and a variable resistor.

7. The hair-styling device according to claim 5, further comprising a visual indicator configured to provide visual feedback to a user.

8. The hair-styling device according to claim 7, wherein the visual indicator comprises one or more of a light, a light-emitting diode (LED), a display, and a screen.

9. The hair-styling device according to claim 4, wherein the electricity source comprises a cord for receiving electricity from an electrical outlet, a battery, or a combination thereof.

10. A method of making a hair styling device, the method comprising:

providing a first arm extending along a longitudinal axis between a first proximal end and a first distal end, the first arm having a first heating plate disposed on a first surface of the first arm;

providing a second arm having a second proximal end and a second distal end;

providing a hinge portion; and joining the first arm adjacent the first distal end and the second arm adjacent the second distal end to the hinge portion such that the first and second arm are positionable in an open position and a closed position, wherein the first arm is rotatable in relation to the second arm and rotates about its longitudinal axis such that the heating plate on the first surface of the first arm faces the second arm in a first position, and faces away from the second arm in a second position;

wherein, in the closed position, the heating plate on the first surface of the first arm can be selectably oriented in either the first position or the second position.

11. The method of claim 10, further comprising:

providing an electricity source; and electrically coupling the first heating plate to the electricity source such that the electricity source is configured to provide an electrical current to the first heating plate.

12. The method of claim 10, wherein the first arm is rotatable around the longitudinal axis about 180 degrees.

13. The method of claim 10, wherein the hair-styling device includes a visual indicator configured to provide visual feedback to a user.

14. The method of claim 13, wherein the visual indicator comprises one or more of a light, a light-emitting diode (LED), a display, and a screen.

15. The method of claim 11, further comprising providing a controller coupled to the first heating plate and the electricity source such that the amount of the electrical current provided to the first heating plate is adjustable by a user, wherein the controller comprises at least one of a dial, a button, a switch, a toggle, a touch screen, and a variable resistor.

* * * * *